United States Patent [19]

Sahyun

[11] 4,001,022

[45] Jan. 4, 1977

[54] PHOTOGRAPHIC MATERIALS COMPRISING DEVELOPER LAYERS AND BINDERS COMPRISING SILICA SOL

[75] Inventor: Melville R. V. Sahyun, St. Paul, Minn.

[73] Assignee: Minnesota Mining and Manufacturing Company, St. Paul, Minn.

[22] Filed: Aug. 13, 1975

[21] Appl. No.: 604,354

[52] U.S. Cl. ..... 96/76 R; 96/95; 96/114; 96/114.4

[51] Int. Cl.[2] ..... G03C 1/48; G03C 1/06; G03C 1/72; G03C 1/31

[58] Field of Search ..... 96/76 R, 114, 14.4, 96/95, 96

[56] References Cited

UNITED STATES PATENTS

| | | | |
|---|---|---|---|
| 2,614,927 | 10/1952 | Broughton et al. | 96/95 |
| 3,041,170 | 6/1962 | Haist et al. | 96/76 R |
| 3,265,501 | 8/1966 | Johnston | 96/76 R |
| 3,372,031 | 3/1968 | Baylis et al. | 96/76 R |
| 3,507,661 | 4/1970 | Ofstead | 96/114 |
| 3,595,652 | 7/1971 | Farney | 96/76 R |
| 3,637,391 | 1/1972 | Saleck et al. | 96/94 R |
| 3,930,859 | 1/1976 | Corrigan | 96/76 R |

FOREIGN PATENTS OR APPLICATIONS

| | | |
|---|---|---|
| 1,276,894 | 6/1972 | United Kingdom |

*Primary Examiner*—David Klein
*Assistant Examiner*—Richard L. Schilling
*Attorney, Agent, or Firm*—Alexander, Sell, Steldt & DeLaHunt

[57] ABSTRACT

A rapid drying photographic element suitable for rapid processing by the stabilization process is provided. The element comprises a support bearing (1) an acidic developer layer and (2) a basic gelatino-silver halide emulsion layer, both layers containing a binder comprising a substantial amount of colloidal silica.

5 Claims, No Drawings

PHOTOGRAPHIC MATERIALS COMPRISING DEVELOPER LAYERS AND BINDERS COMPRISING SILICA SOL

This invention relates to photography and particularly to a photosensitive element containing both silver halide and silver halide developer that is amenable for rapid processing.

Silver images are conventionally produced in photographic elements having a silver halide emulsion layer by a process that includes, after exposure of the element, at least the steps of (1) developing with a solution of a silver halide reducing agent, (2) fixing with a silver halide solvent, (3) washing, and (4) drying. Quality images are obtained only when an appreciable amount of time is allowed for each of the steps. The rapid processing of the photographic elements cannot be accomplished by shortening the time of any of the steps of the process without reducing the quality of the image.

Rapid processing of silver halide photographic elements is possible in a process that has become known as stabilization processing. In this process, the normal fixing and washing steps are eliminated and in their place is used a single step in which the developed element is treated with a stabilizing bath. In the stabilizing bath, undeveloped silver halide is not necessarily removed but is converted to a light insensitive silver complex. The treated element is then dried without washing. Stabilization processing is discussed in an article by H. D. Russel, E. C. Yackel and J. S. Bruce in PSA Journal 16B, 59–62 (1950); and, among other patents, in U.S. Pat. No. 2,448,857 (issued 9-7-58), French Pat. No. 1,206,359 (issued 8-24-59), and U.S. Pat. No. 3,212,895 (issued 10-19-65).

A further advance in the rapid processing of silver halide photographic elements is made by the incorporation of silver halide developing agents into the photographic element. With this modification, silver images are produced after exposure by a process comprising the steps of (1) activation with a normally alkaline activation bath (in place of the development step), and (2) stabilization (in place of the fixing and washing steps). Photographic silver halide elements containing silver halide developers which may be processed by the activation/stabilization process are described, for example, in U.S. Pat. Nos. 2,614,927; 3,243,296 and 3,392,019.

Another advance in the rapid processing of silver halide photographic elements is made by the incorporation of both silver halide developing agents and stabilizing agents into the silver halide photographic emulsion of the element. With such an element, silver images are produced, after exposure, by a one-step process of activation with an alkaline solution. Silver halide elements containing silver halide developing agents and stabilizing agents which may be processed by the one-step activation process are described, for example, in U.S. Pat. No. 3,220,839 (Example 5), U.S. Pat. No. 3,301,678 (Example 44), and Defensive Publication T870,007.

From the above, it is apparent that much effort has been expended to provide silver halide photographic elements and processing procedures which will allow rapid processing of such materials. There is, accordingly, a continuing need to provide silver halide photographic elements having improved physical characteristics in respect to speed of processing and rate of drying, yet providing desired image density with freedom from surface irregularities, background discoloration and mottle and having stability both before exposure and after processing.

In accordance with the invention, there is provided a photographic element which is useful for rapid processing by the stabilization process and which is rapid drying following such processing. The photographic element of the invention comprises a support bearing superposed in either order: (1) a developer layer coated from a stable aqueous developer composition having a pH below 7 and comprising a silver halide developing agent and a hydrophilic binder of which a substantial amount is a silica sol, and (2) a gelatino-silver halide emulsion layer coated from an aqueous silver halide composition having a pH from about 7 to about 10.5 and comprising a dispersion of silver halide in a binder that comprises by weight on a dry basis (a) about 60 to 95% colloidal silica, and (b) about 5 to 40% of another hydrophilic silver halide protective colloid, the major portion of which is gelatin.

Colloidal silica suitable for use in the layers of the photographic element of the invention are obtained from silica aquasols having colloidal silica particles from about 0.5 to about 500 millimicrons in diameter and preferably about 5 to 50 millimicrons in diameter. The silica sols are prepared either by peptization of silica hydrogel or by gradual destabilization of alkali silicates by acids as, for example, carbon dioxide and sulfuric acid, such processes being well known in the art. Suitable silica sols are commercially available such as the "Syton" silica sols (a trademarked product of Monsanto Inorganic Chemicals Div.), the "Ludox" silica sols (a trademarked product of duPont de Nemours & Co., Inc.), and the "Nalco" and "Nalcoag" silica sols (trademarked products of Nalco Chemical Co.). Examples of suitable Nalcoag silica sols include Nalcoag 1034-A, Nalcoag 1115, Nalcoag 1060, Nalcoag 1050 and Nalcoag 1030 having pH's of 3.1, 8.5, 9.0, and 10.2 respectively. The acidic silica sols (i.e., pH below about 7) are generally used in the developer layer compositions and the alkaline silica sols (i.e., pH at least 7) in the silver halide layer compositions. Acidic silica sols, however, are also readily used in the silver halide layer composition by conversion to an alkaline silica sol by rapid addition of sufficient base. Likewise, alkaline silica sols may be used in the developer layer composition by conversion to an acidic silica sol by rapid addition of sufficient acid. The use of large amounts of alkaline silica sol in silver halide emulsions to reduce swelling and drying time is described in British Patent specification No. 1,276,894.

Silver halide developing agents that may be used in the developer layer composition may be any of the developing agents commonly employed in silver halide photography. Suitable silver halide developing agents include, for example, the polyhydroxybenzenes such as the hydroquinone developing agents, e.g., hydroquinone, catechol, o-chlorohydroquinone, t-butylcatechol, methoxyhydroquinone; the aminophenols, e.g., N-methyl-p-aminophenol sulfate; the hydroxy amines, e.g., N-hydroxy morpholine; the 3-pyrazolidones, e.g., 1-phenyl-3-pyrazolidone, 1-phenyl-4,4-dimethyl-3-pyrazolidone and others as described in British Pat. No. 930,572. Such developing agents can be used alone or in combination.

The hydrophilic silver halide protective colloid suitable for use in the silver halide compositions includes gelatin. However, other gelatin compatible hydrophilic colloids that can be present in minor amounts include gum arabic, albumin, zein, polyvinyl alcohol, polyvinyl pyrrolidione, hydrolyzed cellulose esters, and other materials recognized in the art as useful in the preparation of silver halide emulsions, such as the gelatin containing dispersions disclosed in U.S. Pat. No. 3,507,661.

Supports for use in the element of the invention can be any of the supports commonly used in the photographic art. Preferred supports are of paper such as subbed polyethylene coated paper (termed RC Paper in the industry) and Baryta paper. Other supports include polyester films, e.g., polyethyleneterephthalate, cellulose acetatebutyrate, polystyrene, and other resinous films, metals, wood and glass which do not interact with the coatings.

The element of the invention is prepared by sequentially coating, in either order, on the same said of a substrate a layer of the acidic developer composition and a layer of the alkaline silver halide emulsion composition, drying to a tack-free state the first layer coated and after the second layer is coated, drying the second layer. In some instances, it is desirable to prepare elements having more than one layer of either or both of the compositions. Generally, the developer composition is coated first onto the substrate, the coated layer dried, and then the silver halide emulsion composition coated onto the dried developer layer. The silver halide emulsion layer is then dried. The silver halide emulsion layer may be applied first and the developer layer thereon. Also, it is within the scope of the invention to prepare elements having more than one developer layer and/or more than one silver halide emulsion layer, preferably alternating a developer layer and an emulsion layer. The first layer must be dried to a greater degree of dryness than is normal for a gelatino-silver halide emulsion. With the incorporation of the silica sol composition of this invention into the layers, and the differing pH of the developer and silver halide layers, insufficient drying of the first layer before coating of the second composition results in migration of components between layers. Thus, the migration of acidic components into the gelatin-silver halide layer produces objectionable mottle formation therein. Drying the first layer to at least a tack-free condition is therefore essential. This mottle problem and the need for a pH of at least 7 in the silver halide layer (together with the critical drying requirements) appear to be unique to constructions in which the silver halide layer contains both gelatin and silica sol, and either basic or acidic conditions can be tolerated in the silver halide layer if the binder is all gelatin or all silica sol.

The developer composition suitable for the developer layer is prepared by the incorporation of a silver halide developer, such as catechol, into an acidic silica sol. Generally, the developer is added in amounts such that the developer layer prepared therefrom will contain an amount sufficient to bring about, on activation, the development of exposed silver in an adjacent silver halide emulsion layer. Amounts, however, of developer from 5% to about 25% of the silica weight can be added. At least 45 weight percent of the binder solids is silica. Based on total dry weight the essential components are present in the following amounts:

developer: 2.25 to 20 wt.%
silica: at least 45 wt.%
other binder: 0 to 52.75 wt.%

Generally, for facility in coating, the weight percent of silica in the liquid coating composition is adjusted to about 10 to 30%, and preferably to about 15%. The pH of the composition can be between about 2 and 7. However, since the time that a silica sol is stable against gel formation depends, as is generally known (see page 44, E. Matijevic, *Surface and Colloid Science*, Wiley & Sons, 1973), on the pH of the sol (among other factors such as the electrolyte concentration and temperature), the pH of the composition is adjusted to a value suitable for coating conditions. Thus, since silica sols have a comparatively long stability against gel formation at a pH of between about 1.5 and 3.5 and above about 6.5, these ranges are used for ease in coating. Where a more rapid gelling composition is desired and with equipment available for the rapid mixing of components and rapid coating, pH's outside these ranges (e.g., pH less than 1.5 or between about 3.5 and 6.5) may be used. With incomplete drying, there is increasing difficulty in maintaining integrity of the layers because of reaction of the acidic developer composition with the basic emulsion composition.

The silver halide emulsion composition suitable for the gelatino-silver halide emulsion layer of the element of the invention is prepared by the addition of a basic silica sol to a silver halide gelatin emulsion. Any conventional silver halide emulsion having conventionally formed grains of silver chloride, silver bromide, silver iodide or mixtures thereof can be used. In general, these emulsions contain about 1 to 10, preferably 2 to 4, parts by weight of silver per part by weight of protective colloid. Silica sol is added to the emulsion in an amount such that there is formed a dispersion having about 1.5 to 15 parts by weight of silica per part of protective colloid. The following represents percentages of critical components on a dry weight basis:

Silver halide: 20 – 50%
Silica: 30 – 75%
Gelatin: 5 – 20%

Stated in another manner, the gelatin constitutes from 6 to 40 weight percent of total binder, the remainder being essentially silica.

Although the above described developer compositions and silver halide emulsion compositions may be used as taught to prepare photographic elements of the invention, it is preferable to incorporate a plasticizer into the developer and/or emulsion layers. For example, glycol, glycerine and like materials can be used. Preferred plasticizers are the latexes of neutral film forming polymers including polyvinylchloride, polyethylene, polyvinyl esters, e.g., polyvinyl acetate, and acrylates and methacrylates of lower alkanols, e.g. polyethylacrylate and polybutylmethacrylate. Depending on the characteristics of the plasticizer, up to about 35% of the total weight of the binder may be plasticizer.

The silver halide emulsion may be chemically sensitized by any of the well known techniques in emulsion making, for example, by digesting with naturally active gelatin or various sulfur, selenium or tellurium compounds and gold compounds. The emulsions can be sensitized by noble metals of Group VIII of the Periodic Table which have an atomic weight greater than 100. The emulsions may also contain speed increasing addenda such as quaternary ammonium salts, polyoxyethylene glycols, thioethers and the like.

The emulsions also can be spectrally sensitized with cyanine dyes such as basic or acid carbocyanines, cyanine dyes of the betaine type, rhodacyanine, or merocyanine dyes, styrol or oxandol dyes. Suitable sensitizers are described by F. M. Hamer, "The Cyanine Dyes and Related Compounds", Interscience Publishers (1964).

Stabilizing agents may also be incorporated into the construction, if desired, so as to permit processing in one step with an alkaline solution.

EXAMPLE 1

Photographic materials suitable for rapid processing by the stabilization process are prepared by coating a resin coated paper base sequentially with a layer of the following Dispersions I and II:

| Dispersion I | Parts |
|---|---|
| Silica sol (34%), Nalcoag 1034-A | 48 |
| Poly(ethylacrylate)latex (20%) | 10 |
| Catechol | 1.6 |
| Ascorbic acid | 1.6 |
| Water to | 100 |

Dispersion I (having a pH of 2.4) was coated and dried to a tack-free state so that the weight of catechol in the coated layer is about 15 mg./dm$^2$.

| Dispersion II | Parts |
|---|---|
| A silver-chlorobromide emulsion containing 16% silver and 4% gelatin by weight | 15 |
| Silica sol (30%), Nalcoag 1030 | 24 |
| Poly(ethylacrylate)latex (20%) | 4 |
| Glycerin | 2 |
| Saponin (5%) | 2 |
| Benzotriazole | .05 |
| Water to | 100 |

Dispersion II (having a pH of 9.6) was coated over the developer containing layer and dried so that the weight of silver in the emulsion layer was about 30 mg./dm$^2$. A sample of this photographic material was exposed through a 3 log E continuous wedge to 50 mcs (meter-candle-seconds) and processed in a stabilization processor of conventional design using as activator IN sodium hydroxide containing 0.125% phenylmercaptotetrazole and as stabilizer Eastman Kodak Rapid Fixer (a product of Eastman Kodak Company, Rochester, N.Y.). By reflection densitometry, the processed image had a $D_{max}$ of 1.56, a $D_{min}$ of 0.12, a gradient of 0.70 and a speed of 2.7(mcs)$^{-1}$. The processed material exited from the processor tack-free, and dried in about 30 seconds at 23° C. and 50% relative humidity without evidence of curl.

What is claimed is:

1. A photographic element suitable for rapid processing by the stabilization method comprising a support bearing superposed in either order: (1) a developer layer having a pH from about 2 to 7 and comprising a silver halide developing agent and a hydrophilic binder at least 45 weight percent being a silica sol, and (2) a silver halide emulsion layer having a pH from about 7 to about 10.5 and comprising a dispersion of silver halide in a hydrophilic binder that comprises by weight on a dry basis (a) about 60 to 94% colloidal silica, and (b) about 6 to 40% of gelatin.

2. The element of claim 1 in which the silver halide emulsion layer is on top of the developer layer.

3. The photographic element of claim 1 in which at least one of said developer layer and said silver halide emulsion layer contains up to 35% of plasticizer based on the total weight of binder.

4. The photographic element of claim 1 in which at least one of said developer layer and said silver halide emulsion layer contains up to 35% of a film-forming polymer derived from a latex of a neutral film-forming polymer.

5. A photographic element suitable for rapid processing by the stabilization method comprising a support bearing superposed in either order: (1) a hydrophilic developer layer of pH from about 2 to below 7 and comprising, based on total weight of essential solids:

2.25 to 20 wt.% of at least one silver halide developer at least 45 wt.% of silica sol, and (2) a hydrophilic gelatino-silver halide emulsion layer of pH from about 7 to 10.5 and comprising, based on total weight of essential solids:

20 – 50 wt.% of silver halide
30 – 75 wt.% of silica sol
5 – 20 wt.% of gelatin.

* * * * *

UNITED STATES PATENT AND TRADEMARK OFFICE

CERTIFICATE OF CORRECTION

PATENT NO. : 4,001,022

DATED : January 4, 1977

INVENTOR(S) : Melville R. V. Sahyun

It is certified that error appears in the above-identified patent and that said Letters Patent are hereby corrected as shown below:

In Column 3, line 21, the word "said" should be-

-- side --.

In Column 5, line 4, the word "oxandol" should be -

-- oxanol --.

Signed and Sealed this

Fifth Day of April 1977

[SEAL]

*Attest:*

RUTH C. MASON
*Attesting Officer*

C. MARSHALL DANN
*Commissioner of Patents and Trademarks*